US010020134B1

(12) United States Patent
Gibson

(10) Patent No.: US 10,020,134 B1
(45) Date of Patent: Jul. 10, 2018

(54) ELECTRICAL SWITCHING APPARATUS AND SWITCHING ASSEMBLY THEREFOR

(71) Applicant: EATON CORPORATION, Cleveland, OH (US)

(72) Inventor: Jeffrey S. Gibson, Hookstown, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/609,351

(22) Filed: May 31, 2017

(51) Int. Cl.

| | |
|---|---|
| ***H01H 35/26*** | (2006.01) |
| ***H01H 13/10*** | (2006.01) |
| ***H01H 13/14*** | (2006.01) |
| ***H01H 13/70*** | (2006.01) |

(52) U.S. Cl.
CPC ..... *H01H 13/10* (2013.01); *H01H 13/14* (2013.01); *H01H 13/70* (2013.01); *H01H 35/2685* (2013.01); *H01H 2221/03* (2013.01)

(58) Field of Classification Search
CPC ..... H01H 13/20; H01H 13/023; H01H 13/70; H01H 2003/466; H01H 2221/016; H01H 2223/01; H01H 2231/012; H01H 3/12; H01H 35/2685
USPC ..... 200/5 A, 314, 341–345, 83 W
See application file for complete search history.

(56) References Cited

U.S. PATENT DOCUMENTS 5,927,483 A * 7/1999 Yamada ..... H01H 21/22 200/343

* cited by examiner

*Primary Examiner* — Renee Luebke
*Assistant Examiner* — Ahmed Saeed
(74) *Attorney, Agent, or Firm* — Eckert Seamans

(57) ABSTRACT

A switching assembly is for an electrical switching apparatus. The electrical switching apparatus has a base. The switching assembly includes a printed circuit board structured to be coupled to the base, at least one switch mechanically coupled to and electrically connected with the printed circuit board, and an actuation member structured to be coupled to the base. The actuation member has at least one actuation portion having a button portion and an arm portion extending from the button portion. The arm portion is structured to engage and actuate the switch. The actuation portion is structured to move between a FIRST position and a SECOND position. When the actuation portion moves from the FIRST position toward the SECOND position, the button portion moves the arm portion toward engagement with the switch in order to actuate the switch.

20 Claims, 12 Drawing Sheets

ELECTRICAL SWITCHING APPARATUS AND SWITCHING ASSEMBLY THEREFOR

BACKGROUND

Field

The disclosed concept relates generally to electrical switching apparatus such as, for example, circuit breakers. The disclosed concept also relates to switching assemblies for circuit breakers.

Background Information

Electrical switching apparatus such as, for example, circuit switching devices; circuit interrupters such as circuit breakers; network protectors; contactors; motor starters; motor controllers; and other load controllers are used to protect electrical circuitry from damage due to an overcurrent condition, such as an overload condition or a relatively high level short circuit or fault condition. Small power switches are commonly referred to as miniature circuit breakers, and are used, for example, in residential and light commercial electrical distribution systems.

FIG. 1 and FIG. 2 show a portion of a conventional miniature circuit breaker 1. As shown, the circuit breaker 1 includes a base member 4, an actuation member 6 coupled to the base member 4, a printed circuit board (PCB) 12 coupled to the base member 4, and a number of surface mounted switches 14,16 mechanically coupled to and electrically connected with the printed circuit board 12. The switches 14,16 are disposed relatively close together (e.g., spaced a distance of about 0.325 inches from each other). The actuation member 6 has a number of button portions 8,10. Each of the switches 14,16 is generally positioned directly below a corresponding one of the button portions 8,10, as shown in the orientation of FIG. 1 and FIG. 2. Accordingly, the button portions 8,10 provide a mechanism by which an operator can actuate the switches 14,16. That is, when an operator presses the button portion 8, or causes the button portion 10 to be depressed (e.g., by pressing a tool into the button portion 10), the corresponding button portions 8,10 engage and actuate a corresponding one of the switches 14,16. A significant drawback with the circuit breaker 1 is that pressing the button portions 8,10 directly into the switches 14,16 often causes the switches 14,16 to be sheared off of the printed circuit board 12. A possible solution to this drawback involves the use of a hard stop to limit the amount of travel of the button portions 8,10. However, the switches 14,16 typically have very little actuation travel (e.g., about 0.013 inches). Because of this relatively small tolerance, incorporating a hard stop may result in the switches 14,16 not being actuated by the button portions 8,10.

There is, therefore, room for improvement in electrical switching apparatus and in switching assemblies therefor.

SUMMARY

These needs and others are met by embodiments of the disclosed concept, which are directed to an improved electrical switching apparatus and switching assembly therefor.

In accordance with one aspect of the disclosed concept, a switching assembly for an electrical switching apparatus is provided. The electrical switching apparatus has a base. The switching assembly includes a printed circuit board structured to be coupled to the base, at least one switch mechanically coupled to and electrically connected with the printed circuit board, and an actuation member structured to be coupled to the base. The actuation member includes at least one actuation portion having a button portion and an arm portion extending from the button portion. The arm portion is structured to engage and actuate the switch. The actuation portion is structured to move between a FIRST position and a SECOND position. When the actuation portion moves from the FIRST position toward the SECOND position, the button portion moves the arm portion toward engagement with the switch in order to actuate the switch.

In accordance with another aspect of the disclosed concept, an electrical switching apparatus including a base and the aforementioned switching assembly is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
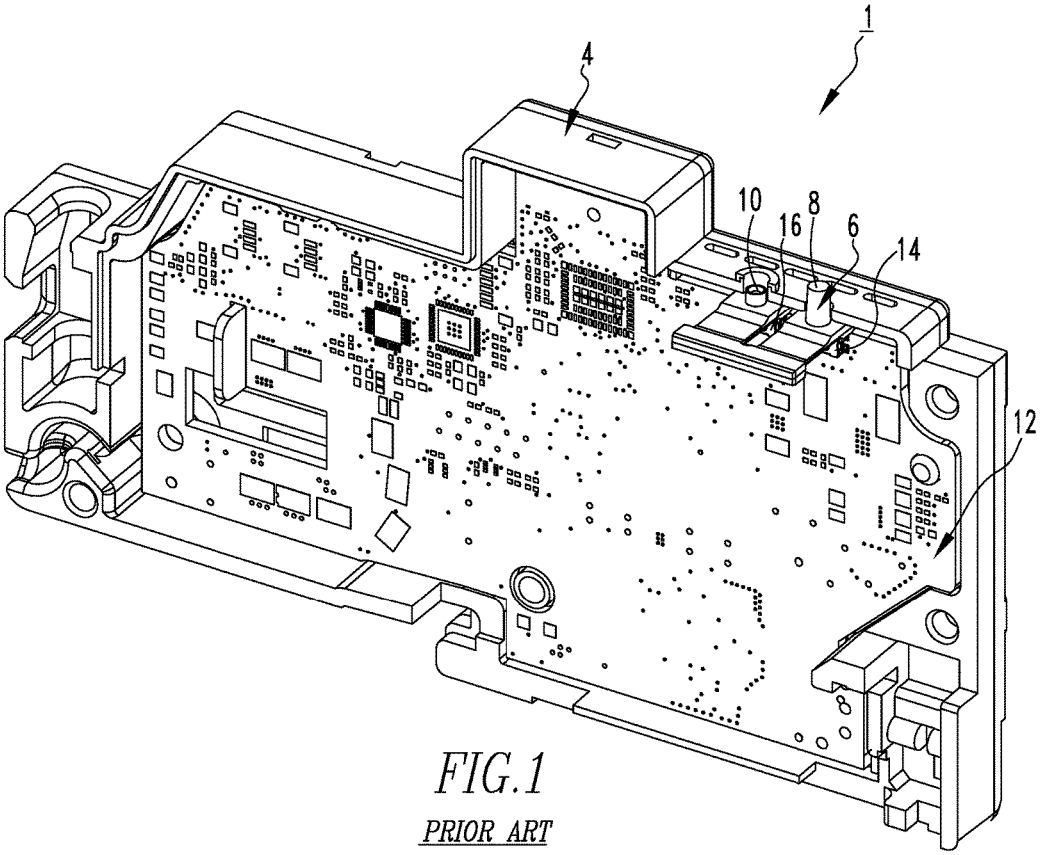
FIG.1 PRIOR ART
FIG. 1 and FIG. 2 are isometric views of a conventional electrical switching apparatus, shown with portions removed in order to see hidden structures.

For purposes of the description hereinafter, directional phrases used herein such as, for example "left", "right", "up", "down", "top", "bottom", and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the statement that two or more parts are "coupled" or "connected" together shall mean that the parts are joined together either directly or joined through one or more intermediate parts.

As employed herein, the term "number" shall mean one or an integer greater than one (i.e., a plurality).

As employed herein, the statement that two or more parts or components "engage" one another shall mean that the parts exert a force against one another either directly or through one or more intermediate parts or components.

Figure 3:
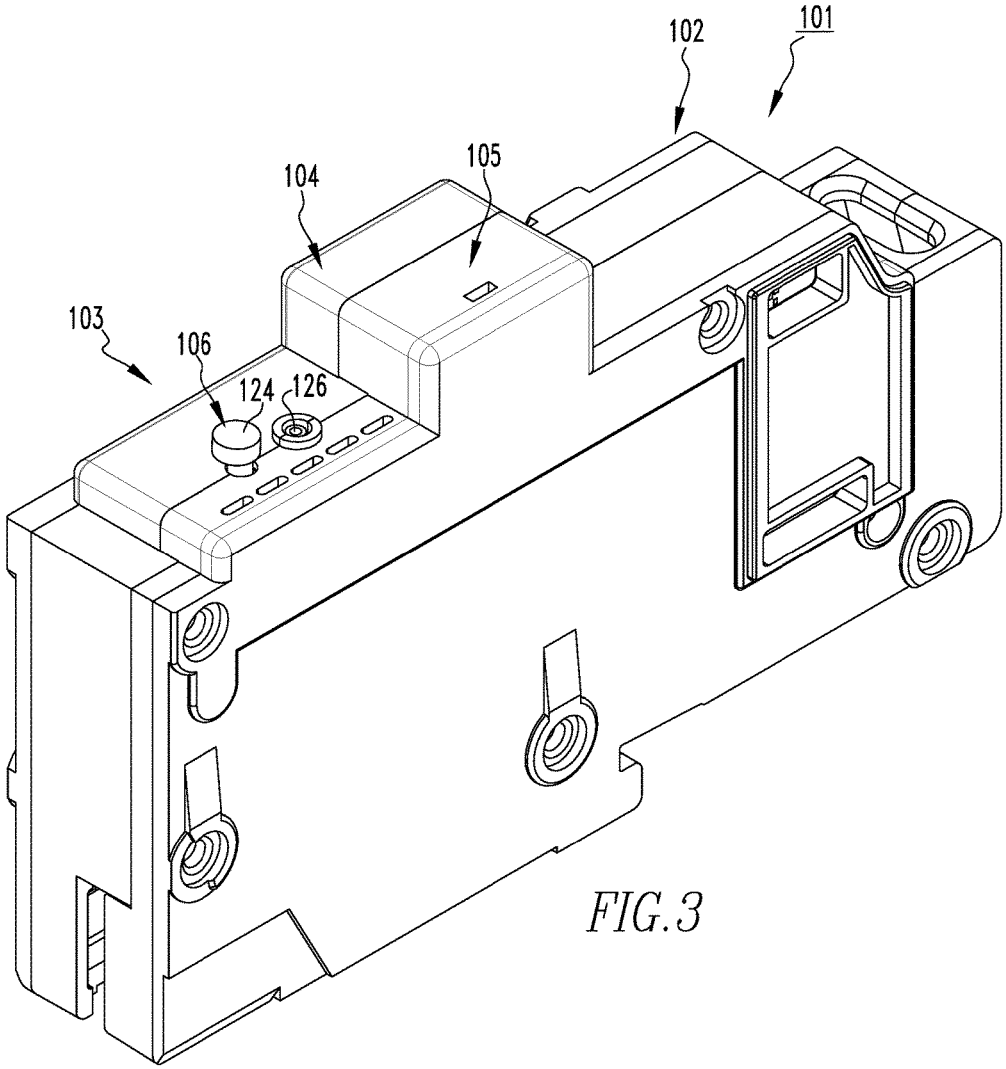
FIG. 3 is an isometric view of an electrical switching apparatus and switching assembly therefor, in accordance with a non-limiting embodiment of the disclosed concept.

FIG. 3 shows an isometric view of a novel electrical switching apparatus (e.g., without limitation, miniature circuit breaker 101), in accordance with one non-limiting embodiment of the disclosed concept. The example circuit breaker 101 includes a base 102 and a switching assembly 103. The base 102 has a first base member 104 and a second base member 105 coupled to the first base member 104.

Figure 4:
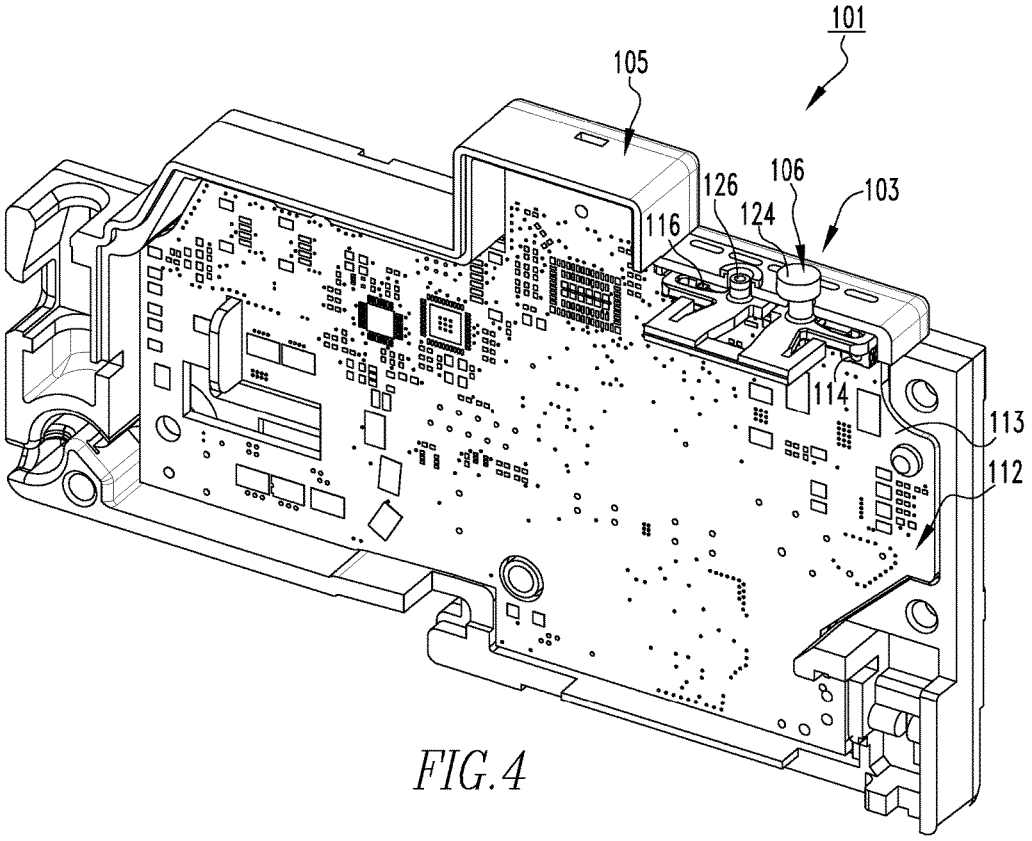
FIG. 4 and FIG. 5 are isometric views of the electrical switching apparatus and switching assembly therefor of FIG. 3, shown with portions removed in order to see hidden structures.
Figure 5:
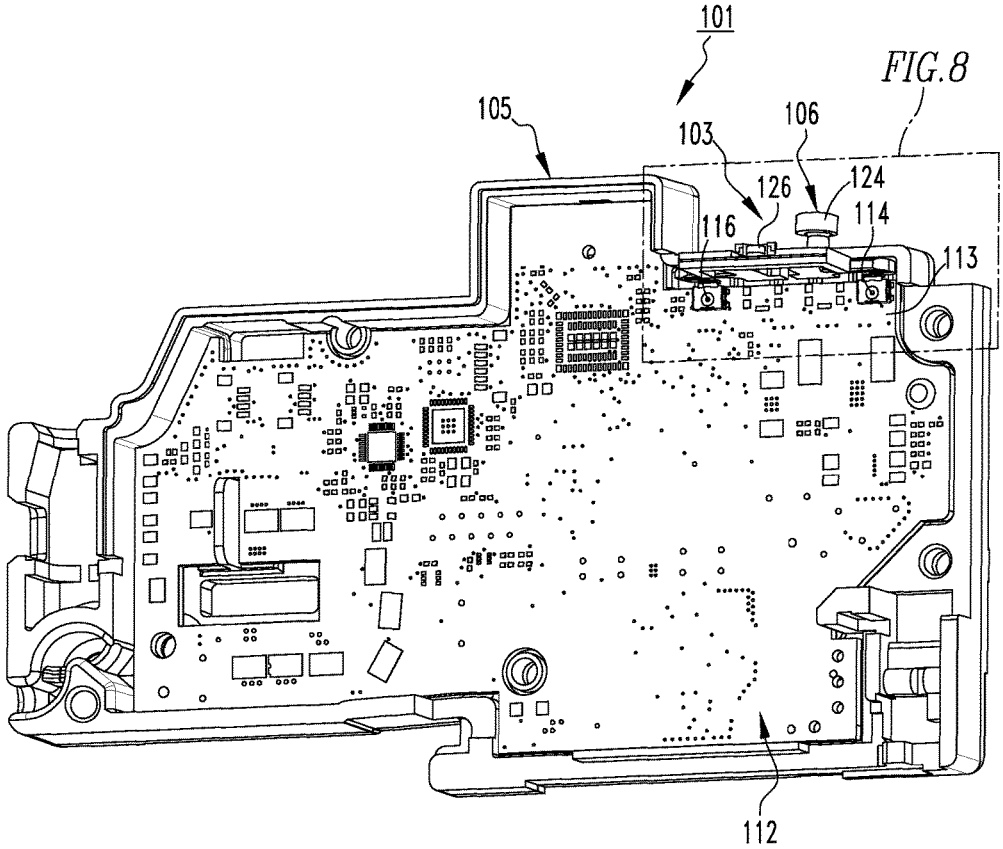

Referring to FIGS. 4 and 5, which show the circuit breaker 101 in part without the first base member 104, the switching assembly 103 includes an actuation member 106, a printed circuit board 112 (PCB) (partially shown in FIGS. 4 and 5) coupled to the second base member 105, and a number of switches (two example switches 114,116 are shown in FIGS. 4 and 5) mechanically coupled to and electrically connected with the printed circuit board 112. The actuation member 106 is coupled to the base members 104,106. In one example embodiment, the switches 114,116 are surface mounted switches 114,116 which do not extend through the printed circuit board 112, but rather are mounted to a surface 113 of the printed circuit board 112. However, alternative embodiments of the disclosed concept are contemplated in which switches other than surface mounted switches are employed. In accordance with the disclosed concept, control of the forces applied to the switches 114, 116 in order to actuate them is a crucial aspect of the disclosed concept. More specifically, in part by employing the novel actuation member 106, actuation of the switches 114,116 can be achieved with a significantly reduced possibility of shearing the switches 114,116 off of the printed circuit board 112.

Figure 6:
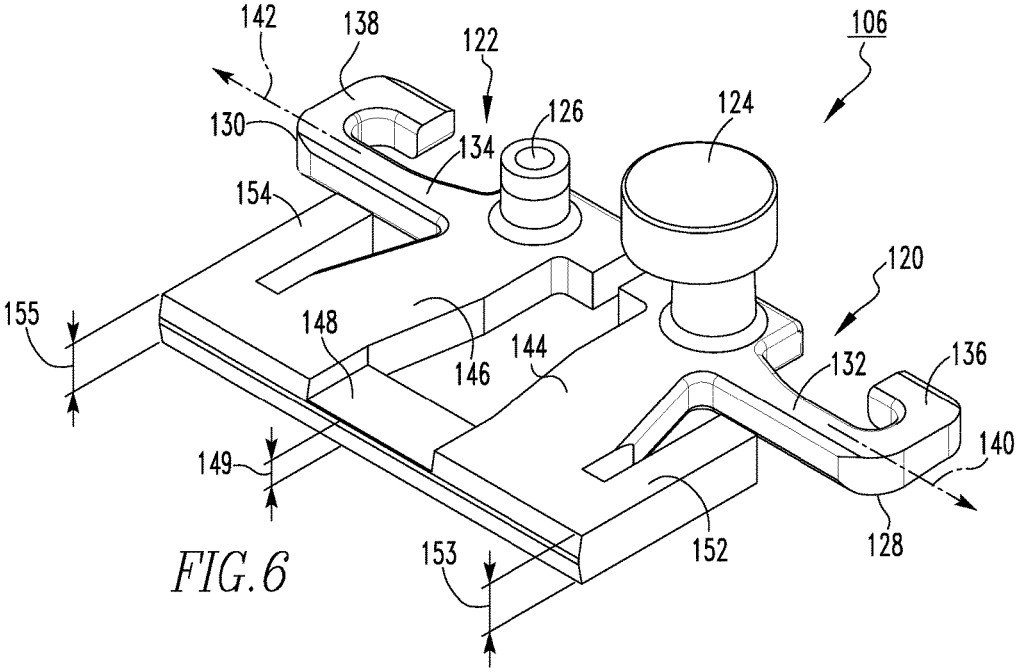
FIG. 6 and FIG. 7 are isometric views of an actuation member for the electrical switching apparatus and switching assembly therefor of FIG. 4 and FIG. 5.
Figure 7:
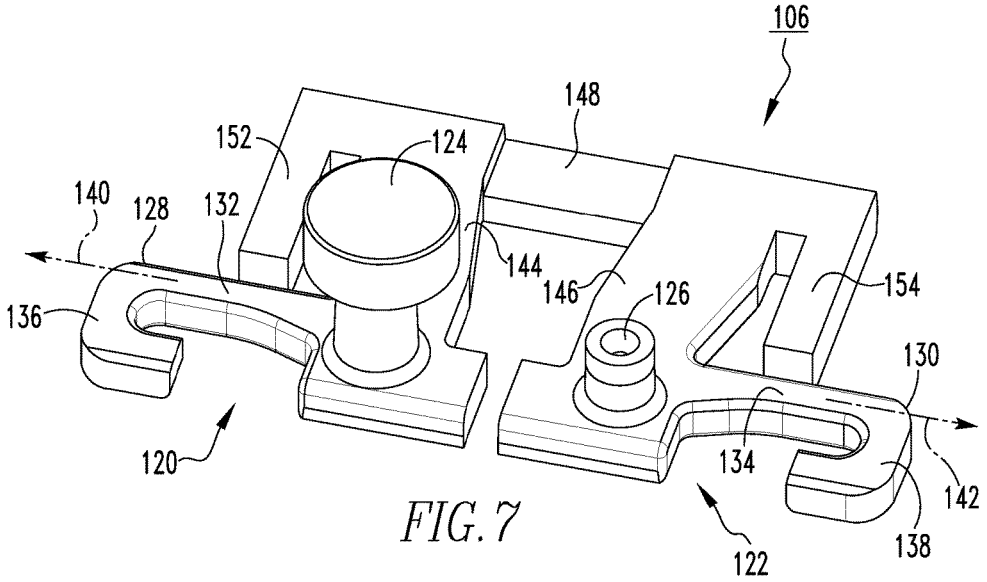

FIGS. 6 and 7 show isometric views of the actuation member 106. The actuation member 106 includes a number of actuation portions (two example actuation portions 120, 122 are shown), a number of beam portions (two example beam portions 144,146 are shown), a connecting portion 148, and a number of stabilizing portions (two example stabilizing portions 152,154 are shown). The actuation portions 120,122 each include a corresponding button portion 124,126 and a corresponding arm portion 128,130 extending from the corresponding button portion 124,126. It will be appreciated that each of the button portions 124,126 extends at least partially through the base 102 (FIG. 3).

Referring again to FIG. 3, the button portion 124 extends entirely through the base 102, and the button portion 126 extends partially through the base 102. As a result, in accordance with one embodiment of the disclosed concept, the button portion 124 is relatively simple to actuate by a user (e.g., without limitation, can be actuated by pressing with a finger) and the button portion 126 is relatively difficult to actuate (e.g., without limitation, can be actuated by inserting a tool (not shown) into the base 102 to engage the button portion 126). This functionality provides a safety mechanism in that the switch 116, which is controlled by the button portion 126, cannot be inadvertently actuated by a user. It will, however, be appreciated that button portions may have any suitable alternative geometry, without departing from the scope of the disclosed concept.

Referring again to FIGS. 6 and 7, in one example embodiment, the arm portions 128,130 are located generally perpendicular to the corresponding button portions 124,126. The arm portions 128,130 each include a corresponding extension portion 132,134 and a corresponding distal portion (e.g., without limitation, hook portions 136,138) extending from the corresponding extension portions 132, 134 and being located opposite and distal the corresponding button portions 124,126. In one example embodiment, the first extension portion 132 extends from the first button portion 124 in a first direction 140, and the second extension portion 134 extends from the second button portion 126 in a second direction 142 opposite the first direction 140.

Figure 10:
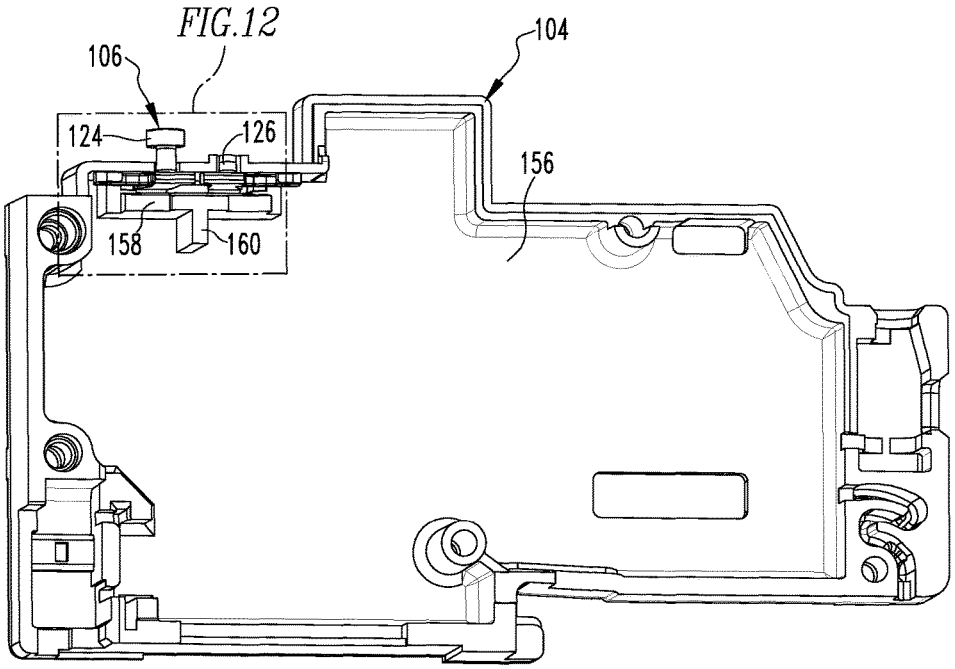
FIG. 10 is an isometric view of the actuation member and a base member for the electrical switching apparatus and switching assembly therefor of FIG. 9.

Continuing to refer to FIGS. 6 and 7, the first beam portion 144 extends from the first button portion 124, the second beam portion 146 extends from the second button portion 126, and the connecting portion 148 connects the first beam portion 144 to the second beam portion 146. As shown, the first stabilizing portion 152 extends from the first beam portion 144 toward the first arm portion 128, and the second stabilizing portion 154 extends from the second beam portion 146 toward the second arm portion 130. In one example embodiment, the first stabilizing portion 152 is located generally parallel to the second stabilizing portion 154. Additionally, the first stabilizing portion 152 has a first thickness 153 (FIG. 6), the second stabilizing portion 154 has a second thickness 155, and the connecting portion 148 has a third thickness 149 less than the first and second thicknesses 153,155. The function of this relative thickness will be more apparent below, in connection with FIGS. 10-12.

Figure 2:
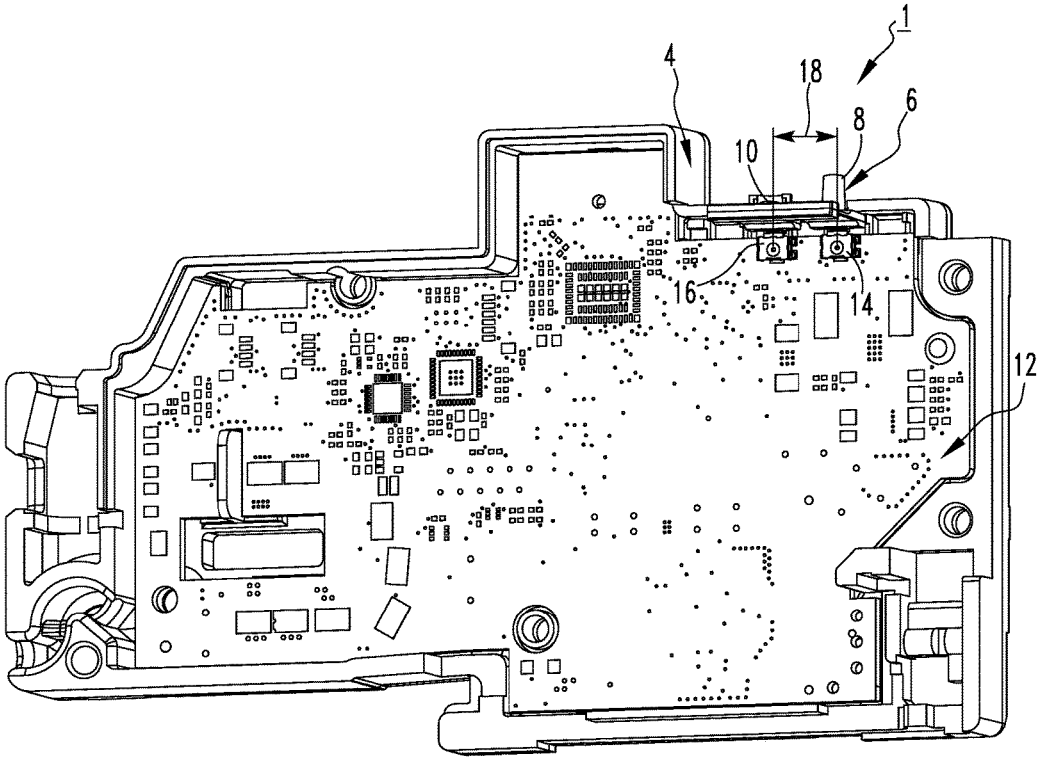
FIG.2 PRIOR ART
Figure 8:
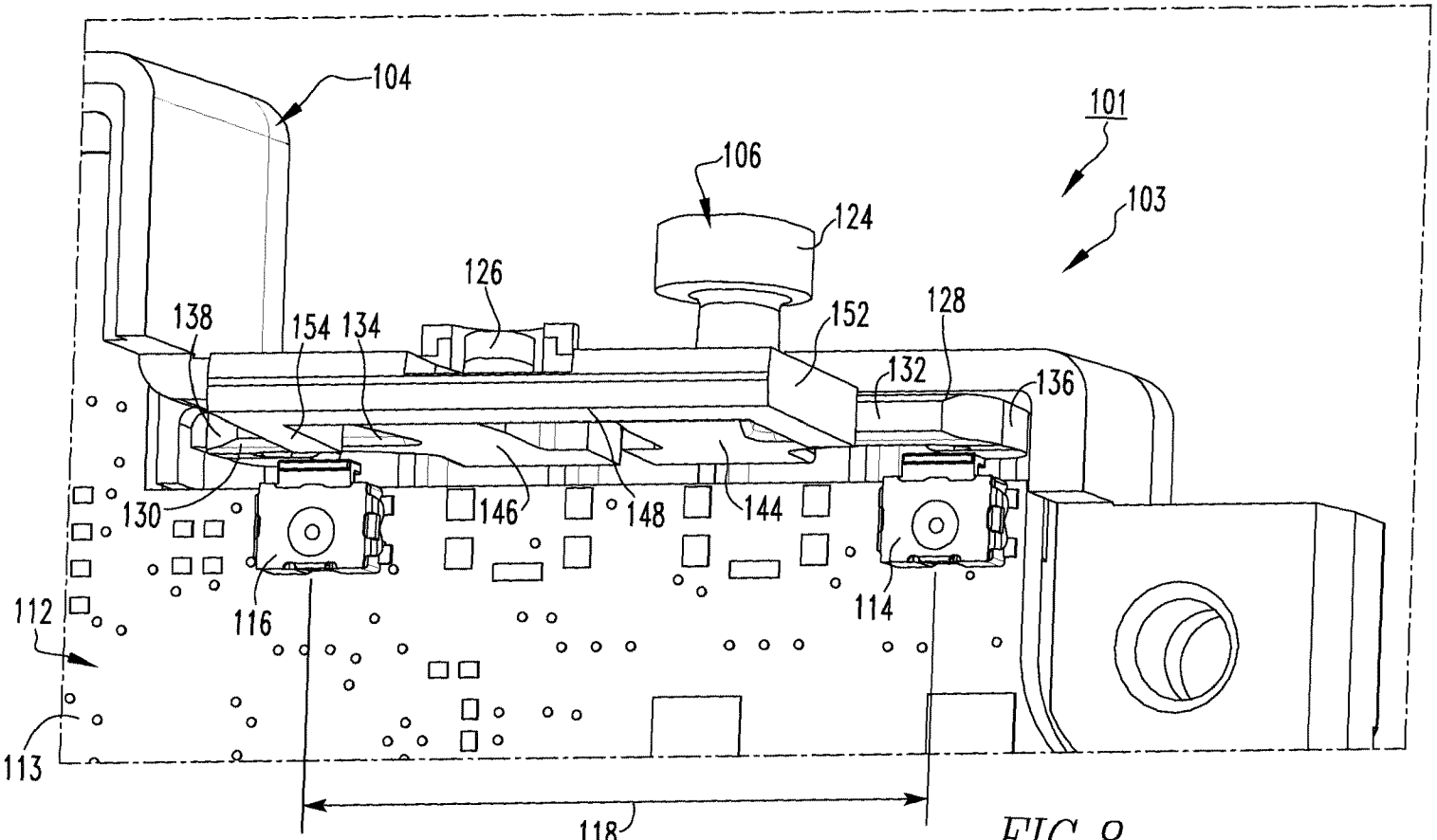
FIG. 8 is an enlarged isometric view of a portion of the electrical switching apparatus and switching assembly therefor of FIG. 5.

The novel functionality of the actuation member 106 to actuate the switches 114,116 will now be described. In accordance with the disclosed concept, the first switch 114 is spaced a distance 118 (FIG. 8) of preferably at least 0.60 inches from the second switch 116, more preferably at least 0.80 inches from the second switch 116, most preferably about 0.85 inches from the second switch 116. Furthermore, as shown in the orientation of FIG. 8, neither of the switches 114,116 are located directly below the corresponding button portions 124,126. Accordingly, it will be appreciated that the button portions 124,126 preferably do not engage and actuate the switches 114,116. That is, when the button portions 124,126 move down, responsive to being moved by an operator, the button portions 124,126 preferably do not engage the switches 114,116. Rather, the arm portions 128,130, and preferably the hook portions 136,138, are each structured to engage and actuate a corresponding one of the switches 114,116. This is distinct from the circuit breaker 1 (FIGS. 1 and 2) in which the switches 14,16 are located directly below the corresponding button portions 8,10 and are structured to be engaged by and actuated by the button portions 8,10, a configuration which presents the discussed drawbacks of potentially shearing the switches 14,16 off of the printed circuit board 12.

Figure 9A:
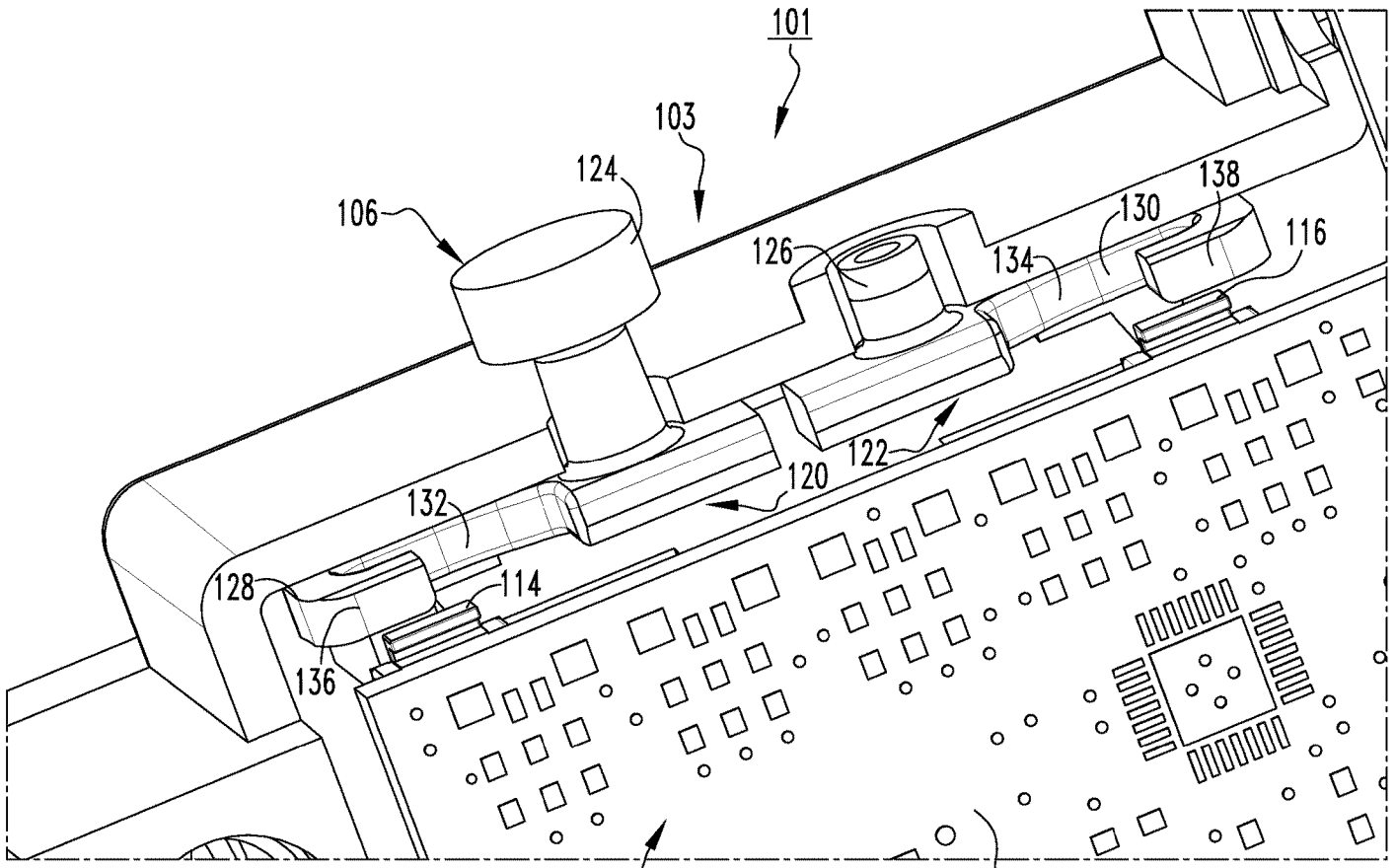
FIG. 9A is an isometric view of a portion of the electrical switching apparatus and switching assembly therefor of FIG. 3, shown with portions removed in order to see hidden structures, and shown with each actuation portion in a corresponding FIRST position.
Figure 9B:
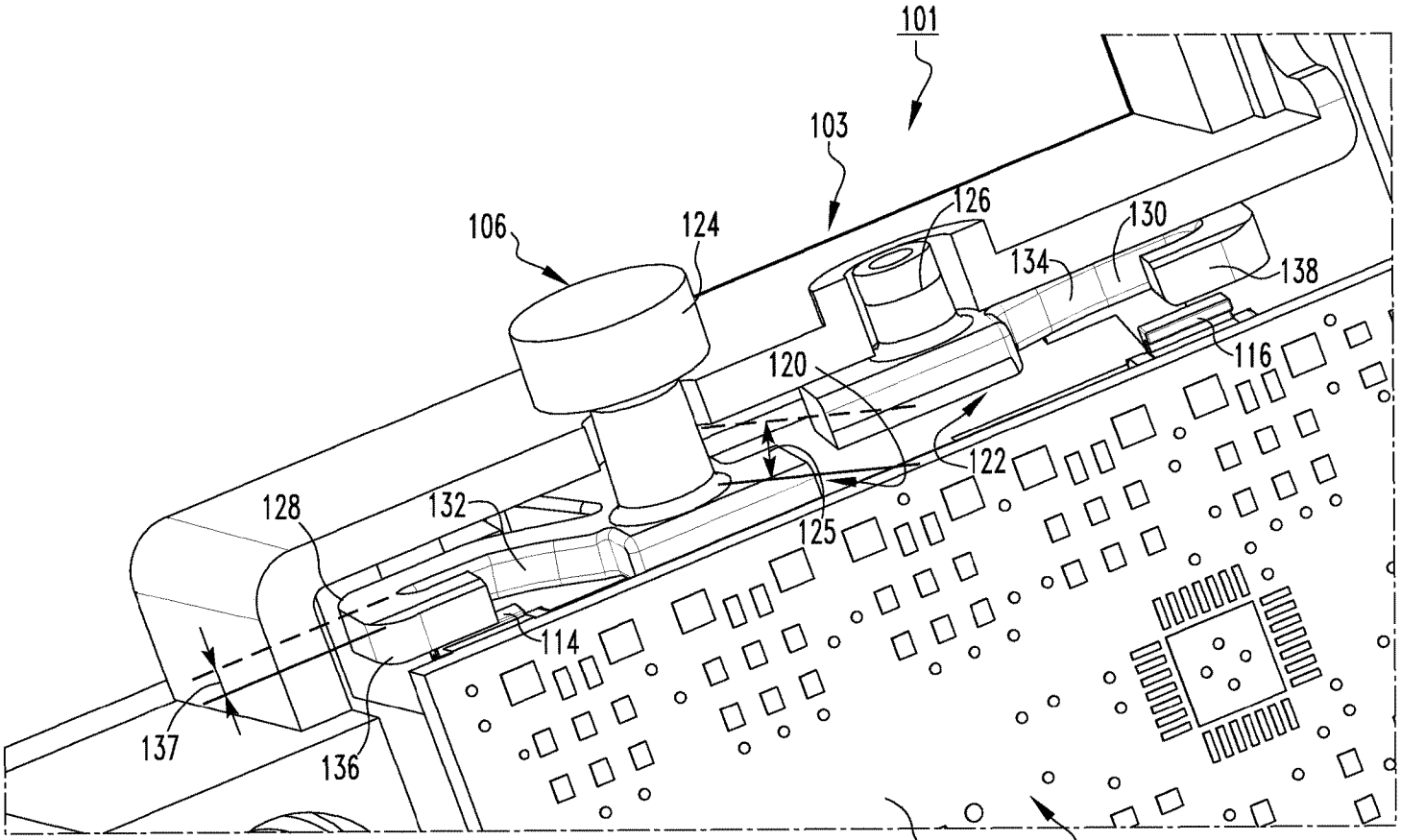
FIG. 9B is an isometric view of a portion of the electrical switching apparatus and switching assembly therefor of FIG. 9A, shown with each actuation portion in a corresponding SECOND position.

Accordingly, it will be appreciated that the actuation portions 120,122 are each structured to move between a FIRST position and a SECOND position. FIG. 9A shows each of the actuation portions 120,122 in a FIRST position corresponding to the button portions 124,126 not being depressed into the circuit breaker 101. In one example embodiment, when the actuation portions 120,122 are in the FIRST position, the hook portions 136,138 are spaced from the corresponding switches 114,116. FIG. 9B shows the first actuation portion 120 in a SECOND position corresponding to the first button portion 124 being depressed such as, for example, responsive to an operator pressing the first button portion 124. It will be appreciated that the actuation portion 122 likewise has a SECOND position (not shown), however for economy of disclosure, only the SECOND position of the actuation portion 120 is illustrated herein. It will also be appreciated that each of the actuation portions 120,122 are biased toward the FIRST position (FIG. 9A). Accordingly, after the actuation portions 120,122 have been moved to the SECOND position (FIG. 9B for the actuation portion 120) by an operator, when the operator releases the corresponding button portions 124,126, the natural bias of the actuation portions 120,122 will return the actuation portions 120,122 to the FIRST position (FIG. 9A).

Continuing to refer to FIG. 9B, the hook portion 136 is engaging the switch 114. By employing hook portions 136,138 as distal portions, stresses imparted to the distal portions (i.e., hook portions 136,138) by the switches 114, 116 are significantly minimized, thereby prolonging the life of the actuation member 106. It will, however, be appreciated that an arm portion could have any suitable alternative geometry (e.g., without limitation, a single continuous extension portion as an arm portion), without departing from the scope of the disclosed concept.

Accordingly, when the first actuation portion 120 moves from the FIRST position (FIG. 9A) toward the SECOND position (FIG. 9B), the first button portion 124 moves the first arm portion 128, and in particular the first hook portion 136, toward engagement with the first switch 114, in order to actuate the first switch 114. It will be appreciated that when the first actuation portion 120 moves from the FIRST position (FIG. 9A) toward the SECOND position (FIG. 9B), the first button portion 124 moves a first distance (see, for example, first distance 125, wherein a dashed top dimension line corresponds to a FIRST position of a portion of the first button portion 124 and a solid bottom dimension line corresponds to the SECOND position of the same portion of the first button portion 124) and the first hook portion 136 moves a second distance (see, for example, second distance 137, wherein a dashed top dimension line corresponds to a FIRST position of a portion of the first hook portion 136 and a solid bottom dimension line corresponds to the SECOND position of the same portion of the first hook portion 136) less than the first distance 125.

It will be appreciated that the disclosed difference in deflection distances 125,137 (FIG. 9B) advantageously allows for relatively safe stress levels and adequate forces to be delivered to the first switch 114, while ensuring that the first switch 114 will still be actuated. That is, an operator can apply a relatively large force to the first button portion 124 and, rather than having the same magnitude force be transmitted to the first switch 114, a reduced and safer force can be transmitted to the first switch 114, while still ensuring that the first switch 114 is actuated. This corresponds to a significantly reduced likelihood that the first switch 114 will be sheared off of the printed circuit board 112 during actuation. It will be appreciated that the second actuation portion 122 is likewise structured to move from a FIRST position (FIG. 9A) to a SECOND position (not shown) in substantially the same manner as the first actuation portion 120.

More specifically, the first and second actuation portions 120,122 are structured to move independently of one another. That is, if an operator presses the first button portion 124, the first switch 114 will be actuated and the second switch 116 will advantageously not be actuated. Correspondingly, if the operator presses the second button portion 126, the second switch 116 will be actuated and the first switch 114 will advantageously not be actuated. In order to achieve this functionality, reference will now be made to FIGS. 10-12, which depict the first base member 104 and the actuation member 106, the first base member 104, and an enlarged view of the first base member 104 and the actuation member 106, respectively.

Figure 11:
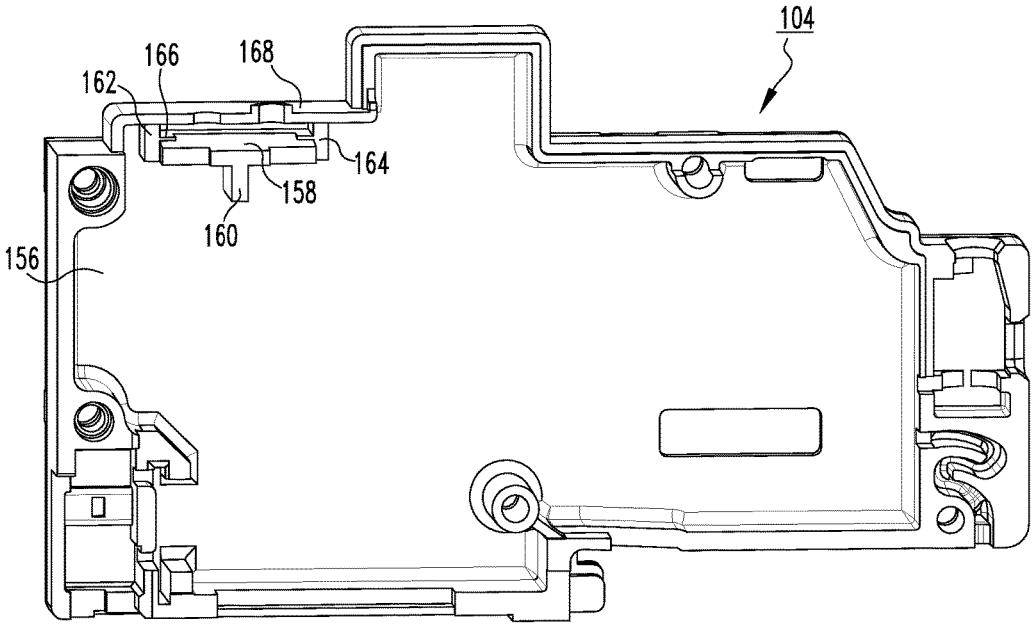
FIG. 11 is an isometric view of the base member of FIG. 10.

As shown in FIG. 11, the first base member 104 has a generally planar body portion 156, a hard stop 158 extending outwardly from the body portion 156, a support portion 160 extending outwardly from the body portion 156 and the hard stop 158, and a number of walls (four example walls 162,164,166,168 are shown in FIG. 11) extending from the body portion 156. The hard stop 158 is located between the support portion 160 and the button portions 124,126. Additionally, the walls 162,164,166,168 define a pocket.

Figure 12:
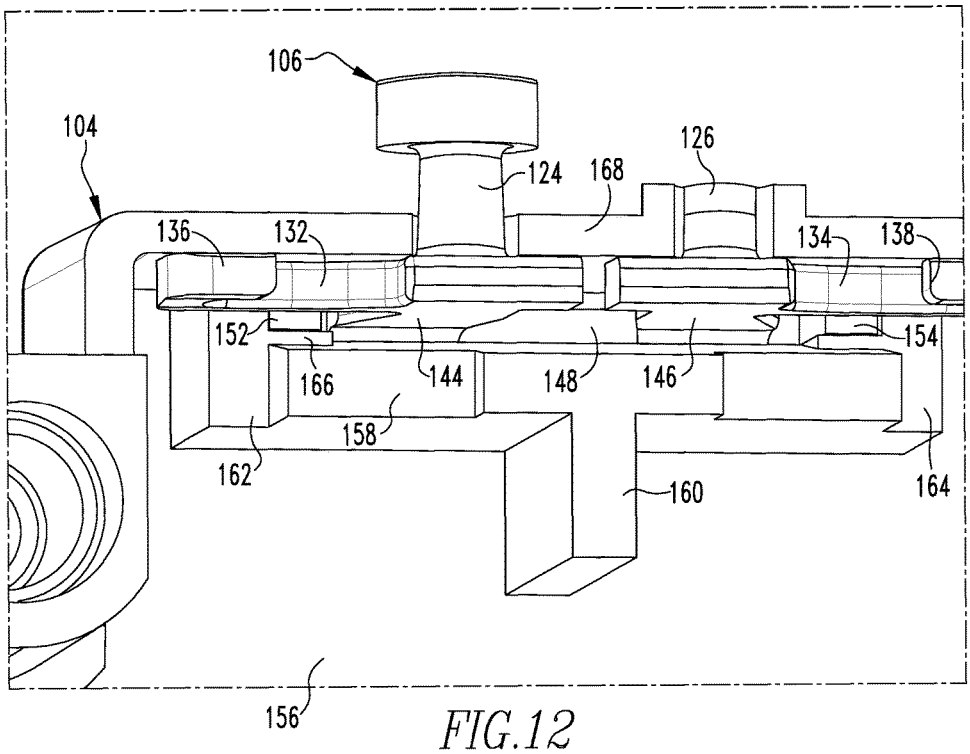
FIG. 12 is an enlarged view of a portion of the actuation member and base member depicted in FIG. 10.

Referring to FIG. 12, the pocket defined by the walls 162,164,166,168 houses and maintains the connecting portion 148, the first stabilizing portion 152, and the second stabilizing portion 154. As such, the connecting portion 148, the first stabilizing portion 152, and the second stabilizing portion 154, which are tightly maintained within the pocket defined by the walls 162,164,166,168, prevent movement of either one of the button portions 124,126 from translating into movement of the other one of the button portions 124,126. Further, the pocket defined by the walls 162,164, 166,168 preferably does not house and maintain the arm portions 128,130. Accordingly, if the button portion 124 moves from the FIRST position (FIG. 9A) to the SECOND position (FIG. 9B), the connecting portion 148, the first stabilizing portion 152, and the second stabilizing portion 154 generally remain fixed (e.g., do not rotate). Additionally, as stated above, the connecting portion 148 is less thick than the stabilizing portions 152,154. This combination of structural attributes (i.e., fixed positioning of the connecting portion 148 and stabilizing portions 152,154 during movement of the actuation portions 120,122, and reduced thickness of connecting portion 148 relative to the stabilizing portions 152,154) advantageously minimizes the likelihood that movement of the first actuation portion 120 will translate into movement of the second actuation portion 122. As a result, when an operator presses the button portion 124, the first switch 114 will be actuated and the second switch 116 will not be actuated.

As previously stated, the first base member 104 has the hard stop 158. The hard stop 158 provides an additional layer of control for the operator, and thus protection for the switches 114,116. More specifically, when the operator causes either one of the button portions 124,126 to be pressed into the circuit breaker 101, the hard stop 158 sets a maximum distance into the circuit breaker 101 which the button portions 124,126, and thus the hook portions 136, 138, can extend. Stated differently, each of the button portions 124,126 are preferably structured to engage the hard stop 158 in order to limit movement of the corresponding button portions 124,126 when the actuation portions 120,122 move from the FIRST position (FIG. 9A) toward the SECOND position (FIG. 9B for the actuation portion 120, not shown for the actuation portion 122). In other words, the corresponding hook portions 136,138 are prevented from moving any further into the circuit breaker 101 by the hard stop 158. That is, the hook portions 136,138 will have moved a maximum distance from their original FIRST position (FIG. 9A). This provides additional control and safety in that the operator no longer need be concerned with shearing switches off of a printed circuit board. Rather, in accordance with the disclosed concept, the operator can press the button portions 124,126 relatively hard such that they move into engagement with the hard stop 158, without concern or worry that the switches 114,116 will be sheared from the printed circuit board 112.

Furthermore, the support portion 160 provides a mechanism to ensure that the hard stop 158 is itself not sheared from the body portion 156 of the first base member 104. More specifically, as shown in FIG. 12, the support portion 160 extends from and is preferably located generally perpendicular to the hard stop 158. As a result, forces associated with the button portions 124,126 pressing into the hard stop 158 will advantageously be transmitted in part to the support portion 160.

While the disclosed concept has been described in association with the actuation member 106 having two actuation portions 120,122, two beam portions 144,146, and two stabilizing portions 152,154, it will be appreciated that a suitable alternative actuation member can have a suitable alternative geometry (not shown), without departing from the scope of the disclosed concept. For example and without limitation, it is within the scope of the disclosed concept for an actuation member to have one single actuation portion (not shown) in order to actuate a single switch (not shown), rather than the actuation member 106 which is structured to actuate two switches 114,116.

Accordingly, it will be appreciated that, among other benefits, the disclosed concept provides for an improved electrical switching apparatus 101 and switching assembly 103 therefor, in which additional control is provided to an operator such that the possibility that a number of switches 114,116 will be sheared off of a printed circuit board 112 during actuation is significantly minimized.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A switching assembly for an electrical switching apparatus, said electrical switching apparatus comprising a base, said switching assembly comprising:

a printed circuit board structured to be coupled to said base;

at least one switch mechanically coupled to and electrically connected with said printed circuit board; and an actuation member structured to be coupled to said base, said actuation member comprising at least one actuation portion having a button portion and an arm portion extending from said button portion, said arm portion being structured to engage and actuate said at least one switch, wherein said at least one actuation portion is structured to move between a FIRST position and a SECOND position, wherein, when said at least one actuation portion moves from the FIRST position toward the SECOND position, said button portion moves said arm portion toward engagement with said at least one switch in order to actuate said at least one switch, and wherein, when said at least one actuation portion moves from the FIRST position to the SECOND position, said button portion moves a first distance and said arm portion moves a second distance less than the first distance in order to prevent said at least one switch from shearing off of said printed circuit board.

2. The switching assembly of claim 1 wherein said at least one switch comprises a first switch and a second switch; wherein said at least one actuation portion comprises a first actuation portion and a second actuation portion; wherein said arm portion of said first actuation portion is structured to engage and actuate said first switch; and wherein said arm portion of said second actuation portion is structured to engage and actuate said second switch.

3. The switching assembly of claim 2 wherein said first switch is spaced a distance of at least 0.60 inches from said second switch.

4. The switching assembly of claim 2 wherein said arm portion of said first actuation portion extends from said button portion of said first actuation portion in a first direction; and wherein said arm portion of said second actuation portion extends from said button portion of said second actuation portion in a second direction opposite the first direction.

5. The switching assembly of claim 2 wherein said actuation member further comprises a first beam portion, a second beam portion, and a connecting portion connecting said first beam portion to said second beam portion; wherein said first beam portion extends from said button portion of said first actuation portion; and wherein said second beam portion extends from said button portion of said second actuation portion.

6. The switching assembly of claim 5 wherein said actuation member further comprises a first stabilizing portion and a second stabilizing portion; wherein said first stabilizing portion extends from said first beam portion; and wherein said second stabilizing portion extends from said second beam portion.

7. The switching assembly of claim 6 wherein each of said first stabilizing portion, said second stabilizing portion, and said connecting portion has a thickness; and wherein the thickness of said connecting portion is less than the thickness of said first stabilizing portion and the thickness of said second stabilizing portion.

8. The switching assembly of claim 6 wherein said first stabilizing portion is disposed generally parallel to said second stabilizing portion.

9. The switching assembly of claim 6 wherein said first stabilizing portion extends from said first beam portion toward said arm portion of said first actuation portion; and wherein said second stabilizing portion extends from said second beam portion toward said arm portion of said second actuation portion.

10. The switching assembly of claim 1 wherein said at least one actuation portion is biased toward the FIRST position.

11. The switching assembly of claim 1 wherein said arm portion has an extension portion and a hook portion extending from said extension portion; wherein said extension portion extends from said button portion; wherein said hook portion is disposed opposite and distal said button portion; and wherein said hook portion is structured to engage and actuate said at least one switch.

12. The switching assembly of claim 1 wherein said arm portion is disposed generally perpendicular to said button portion.

13. An electrical switching apparatus comprising:

a base; and a switching assembly comprising:

a printed circuit board coupled to said base;

at least one switch mechanically coupled to and electrically connected with said printed circuit board; and an actuation member coupled to said base, said actuation member comprising at least one actuation portion having a button portion and an arm portion extending from said button portion, said arm portion being structured to engage and actuate said at least one switch, wherein said at least one actuation portion is structured to move between a FIRST position and a SECOND position, wherein, when said at least one actuation portion moves from the FIRST position toward the SECOND position, said button portion moves said arm portion toward engagement with said at least one switch in order to actuate said at least one switch, wherein, when said at least one actuation portion moves from the FIRST position to the SECOND position, said button portion moves a first distance and said arm portion moves a second distance less than the first distance in order to prevent said at least one switch from shearing off of said printed circuit board.

14. The electrical switching apparatus of claim 13 wherein said base comprises a first base member and a second base member coupled to said first base member; wherein said first base member comprises a body portion and a hard stop extending outwardly from said body portion; and wherein said button portion is structured to engage said hard stop in order to limit movement of said button portion when said at least one actuation portion moves from the FIRST position toward the SECOND position.

15. The electrical switching apparatus of claim 14 wherein said first base member further comprises a support portion extending outwardly from said body portion and said hard stop; and wherein said hard stop is disposed between said support portion and said button portion.

16. The electrical switching apparatus of claim 15 wherein said support portion is disposed perpendicular to said hard stop.

17. The electrical switching apparatus of claim 14 wherein said first base member further comprises a number of walls extending from said body portion; and wherein said number of walls define a pocket.

18. The electrical switching apparatus of claim 17 wherein said at least one actuation portion comprises a first actuation portion and a second actuation portion; wherein said actuation member further comprises a first beam portion, a second beam portion, a connecting portion connecting said first beam portion to said second beam portion, a first stabilizing portion, and a second stabilizing portion; wherein said first beam portion extends from said button portion of said first actuation portion; wherein said second beam portion extends from said button portion of said second actuation portion; wherein said first stabilizing portion extends from said first beam portion; wherein said second stabilizing portion extends from said second beam portion; and wherein said pocket is structured to house and maintain said connecting portion, said first stabilizing portion, and said second stabilizing portion.

19. The electrical switching apparatus of claim 17 wherein said at least one actuation portion comprises a first actuation portion and a second actuation portion; and wherein said pocket does not house and maintain said arm portion of said first actuation portion or said arm portion of said second actuation portion.

20. The electrical switching apparatus of claim 13 wherein said at least one switch comprises a first switch and a second switch spaced a distance of at least 0.60 inches from said first switch; wherein said at least one actuation portion comprises a first actuation portion and a second actuation portion; wherein said arm portion of said first actuation portion is structured to engage and actuate said first switch; wherein said arm portion of said second actuation portion is structured to engage and actuate said second switch; and wherein said electrical switching apparatus is a miniature circuit breaker.

* * * * *